US005862913A

United States Patent [19]

Chou

[11] Patent Number: 5,862,913

[45] Date of Patent: Jan. 26, 1999

[54] TOOL DISPLAY ASSEMBLY

[76] Inventor: Ta-Ching Chou, No. 22, West 4th Alley, Lin 20, Hsi Ping Li, Hua Hsia Lane, Hsi Tun Dist., Taichung, Taiwan

[21] Appl. No.: 988,278

[22] Filed: Dec. 10, 1997

[51] Int. Cl.[6] ..... B65D 85/28

[52] U.S. Cl. ..... 206/378; 206/806; 211/70.6

[58] Field of Search ..... 206/372, 378, 206/806, 496, 1.5; 211/70.6

[56] References Cited

U.S. PATENT DOCUMENTS

| | | | |
|---|---|---|---|
| 4,380,291 | 4/1983 | Shannon | 206/343 |
| 5,484,056 | 1/1996 | Wood | 206/349 |
| 5,740,911 | 4/1998 | Chou | 206/378 |

*Primary Examiner*—Paul T. Sewell
*Assistant Examiner*—Nhan T. Lam
*Attorney, Agent, or Firm*—Hedman, Gibson & Costigan, P.C.

[57] ABSTRACT

A tool display assembly includes a card having a dove-tailed flange formed to a lower edge thereof, at least one connecting member having a dove-tailed groove defined in a top thereof sa as to receive the dove-tailed flange therein and a lower end having four walls extending downwardly therefrom so as to form a rectangular portion to be received in a socket. An aperture is defined through a top of the lower end of the connecting member. A hook member has a hook formed on a top thereof and a stop bar extending transversely from a lower end thereof such that the hook extends through the socket and the rectangular portion and is engaged with the aperture.

7 Claims, 3 Drawing Sheets

TOOL DISPLAY ASSEMBLY

BACKGROUND OF THE INVENTION

1. Field of the Invention

The present invention relates to a tool display assembly and, more particularly, to a tool display assembly having at least one connecting member to connect a tool, such as a socket, to a display card with a hook member securely combining the socket and the connecting member so as to prevent the socket from being stolen.

2. Brief Description of the Prior Art

FIG. 4 shows a conventional socket display assembly which includes a metal plate 60 having a longitudinal protrusion 601 extending centrally from an upper surface thereof and at least one U-shaped member 62 which has two distal ends each having a groove 63 defined in an inner side thereof so as to slidably receive two sides of the metal plate 60 therein. A lower portion 64 of the U-shaped member 62 is used to be force-fitted into an engaging hole 72 of a socket 70. It is to be noted that the lower portion 64 is flexible so that it can be narrowed slightly and force-fitted into the engaging hole 72. After the lower portion 64 is inserted into the socket 70, it applies an outward force against an inner periphery defining the engaging hole 12 such that the socket 70 is connected to the U-shaped member 62.

An inherent problem to be overcome is that the socket 70 could b directly pulled from the U-shaped member 62 or the metal plate 60 intentionally or unintentionally. In addition, when sliding the U-shaped members 62 to the metal plate 60, fingers of assemblers could be hurt by the sharp and thin sides of the metal plate 60.

The present invention intends to provide an improved tool display assembly which is easily operated and effectively prevents the tools on the display assembly from being stolen so as to mitigate and/or obviate the above-mentioned problems.

SUMMARY OF THE INVENTION

The present invention provides a tool display assembly which includes a card having an upper edge and a lower edge which has a dove-tailed flange, at least one connecting member having an upper end with a dove-tailed groove defined therein so as to receive the dove-tailed flange, and a lower end having four walls extending downwardly therefrom so as to form a rectangular portion. The rectangular portion is adapted to be received in a socket and the lower end of the connecting member has an aperture defined in a top thereof and communicating with an interior of the rectangular portion. At least one hook member has a hook formed on a top thereof and a stop bar extending transversely from a lower end thereof such that the hook is adapted to extend through the socket and the rectangular portion and is engaged with the aperture.

It is an object of the present invention to provide a tool display assembly which has a hook member to securely hold a tool on the display card.

It is another object of the present invention to provide a tool display assembly which has the tools connected thereto to be theftproof.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
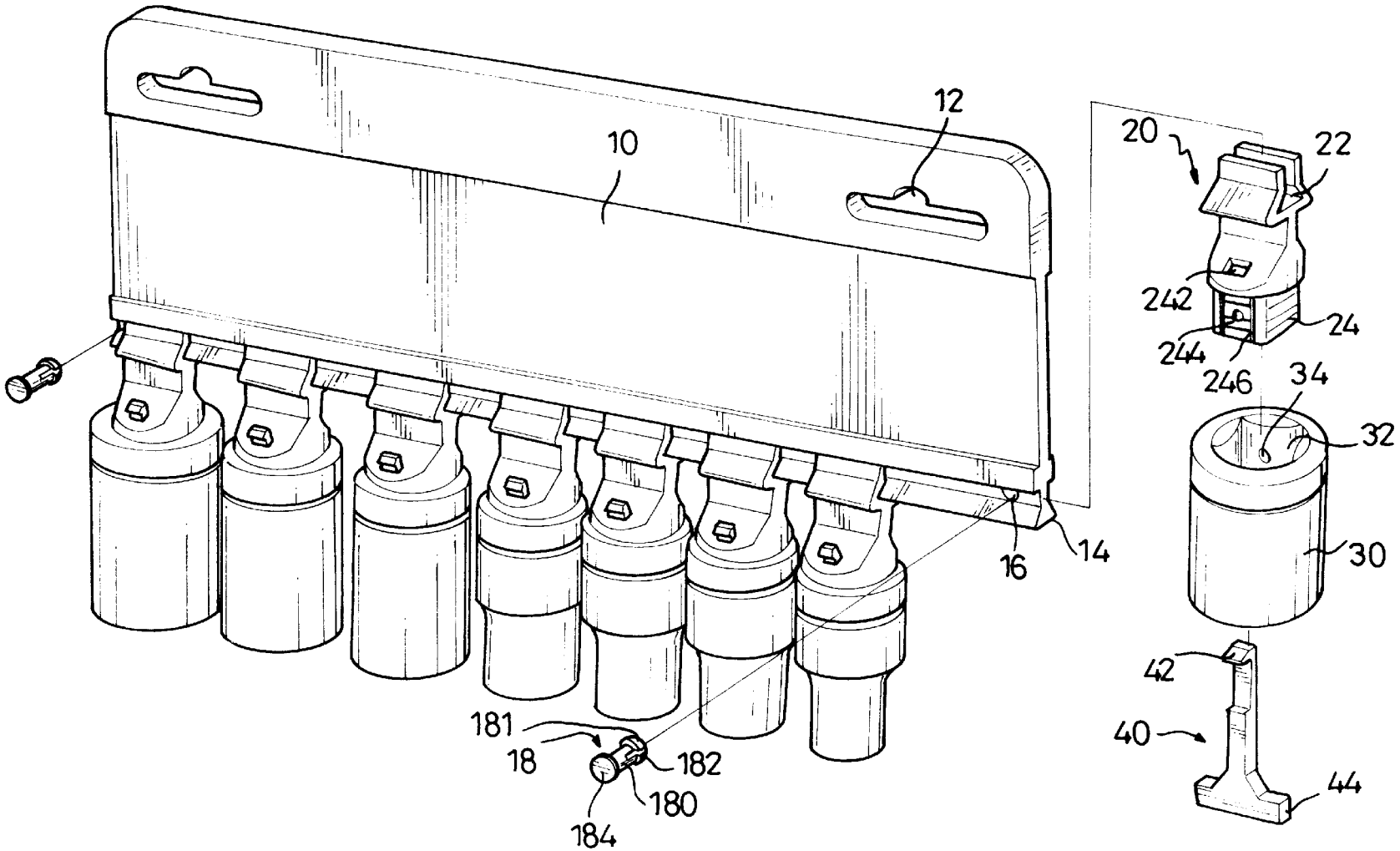
FIG. 1 is an exploded view of a socket and a tool display assembly in accordance with the present invention.
Figure 3:
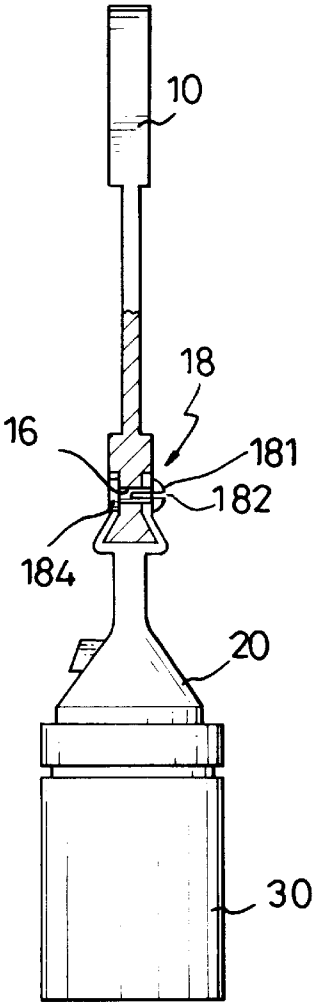
FIG. 3 is a side elevational view, partly in section, of the socket connected to a connecting member which is connected to the card wherein a lock pin extends transversely through the connecting member and the card.
Figure 2:
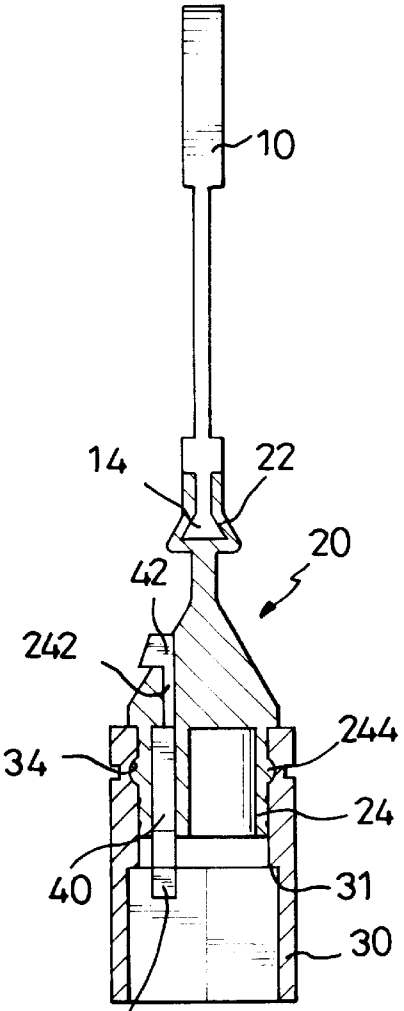
FIG. 2 is a side elevational view, partly in section, of the socket connected to a connecting member which is connected to a card and a hook member disposed between the connecting member and the socket.
Figure 4:
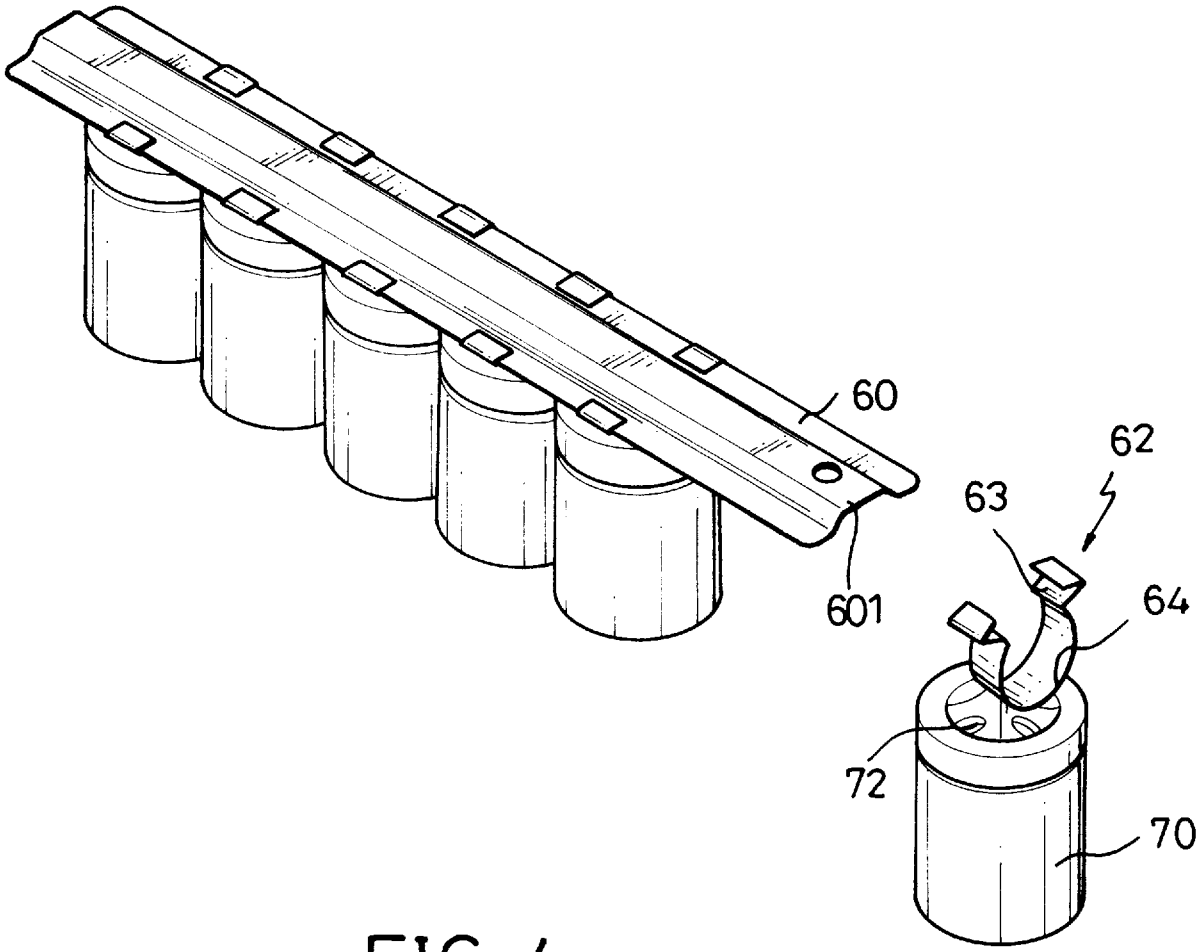
FIG. 4 PRIOR ART
FIG. 4 is an exploded view of a socket and a conventional socket display assembly.

Referring to the FIGS. 1, 2 and 3, a tool display assembly in accordance with the present invention generally includes a card 10 having an upper edge having two holes 12 defined therebelow so that the card 10 may be hung on a wall and a lower edge which has a dove-tailed flange 14 which has two limit holes 16 respectively defined in two ends thereof.

At least one connecting member 20 has an upper end with a dove-tailed groove 22 defined therein so as to receive the dove-tailed flange 14, and a lower end having four walls extending downwardly therefrom so as to form a rectangular portion 24. The rectangular portion 24 has at least one a boss 244 extending laterally from one of the four walls thereof and the well having the boss 24 has two slits 246 defined therethrough so that the wall having the boss 244 is flexible relative to the other three walls. The rectangular portion 24 is to be received in an engaging hole 32 of a socket 30 such that when the rectangular portion 24 is inserted into the engaging hole 32, the boss 244 is received in a dent 34 defined in an inner periphery defining the engaging hole 32. A top of the lower end of the connecting member 20 is an inclined surface through which an aperture 242 is defined. The aperture 242 communicates with an interior of the rectangular portion 24.

At least one hook member 40 has a hook 42 formed on a top thereof and a stop bar 44 extending transversely from a lower end thereof such that the hook 42 extends through the socket and the rectangular portion 24 and is securely received in the aperture 242. A length of the stop bar 44 is designed to be longer than an inner diameter of a step hole 31 in the socket 30 so as to prevent the socket 30 from being pulled from the connecting member 20.

Two lock pins 18 each have a head 181, a bottom 184 and a shank 180 extending between the bottom 184 and the head 181. A lit 182 is longitudinally defined in the head 181 so that the head 181 can be compressed to enter the corresponding limit hole 16 and when the head 182 is released after being extended through the limit hole 16 and returns to it original size which is greater than the size of the limit hole 16, the lock pin 18 can not be removed unless being cut. In this way, the connecting members 20 slidably connected to the dove-tailed flange 14 are limited to be disconnected therefrom.

The upper end of the connecting member 20 is made of a hard material so that it is not possible to break or widen the upper end to remove the connecting member 20 from the dove-tailed flange 14. Furthermore, the hook 42 can only be disengaged from a periphery defining the aperture 242 by cutting the hook 42, and the lock pins 18 also have to be cut so they can be removed from the card 10 whereby the tool display assembly of the present invention is theftproof.

Although the invention has been explained in relation to its preferred embodiment, it is to be understood that many other possible modifications and variations can be made without departing from the spirit and scope of the invention as hereinafter claimed.

What is claimed is:

1. A tool display assembly comprising:

a card having an upper edge and a lower edge which has a dove-tailed flange;

at least one connecting member having an upper end with a dove-tailed groove defined therein so as to receive said dove-tailed flange, and a lower end having four walls extending downwardly therefrom so as to form a rectangular portion, said rectangular portion being adapted to be received in a socket, said lower end of said connecting member having an aperture defined in a top thereof and said aperture communicating with an interior of said rectangular portion, and at least one hook member having a hook formed on a top thereof and a stop bar extending transversely from a lower end thereof such that said hook being adapted to extend through said socket and said rectangular portion and engaged with said aperture.

2. The tool display assembly as claimed in claim 1 wherein said rectangular portion has a boss extending laterally from one of said four walls thereof.

3. The tool display assembly as claimed in claim 1 wherein said top of said lower end of said connecting member is an inclined surface through which said aperture is defined.

4. The tool display assembly as claimed in claim 1 wherein said card has at least one hole defined therethrough near said upper edge thereof.

5. The tool display assembly as claimed in claim 1 wherein said rectangular portion has two slits defined through said wall having said boss extending therefrom so that said wall having said boss is flexible.

6. The tool display assembly as claimed in claim 1 wherein said card has two limit holes respectively defined in two ends of said dove-tailed flange so as to have a lock pin extending through each one of said two limit holes.

7. The tool display assembly as claimed in claim 6 wherein said lock pin has a head, a bottom and a shank connected between said bottom and said head, a slit longitudinally defined in said head.

* * * * *